US005259812A

United States Patent [19]

Kleinsek

[11] Patent Number: 5,259,812

[45] Date of Patent: Nov. 9, 1993

[54] CLEAN ROOM AND CLEAN ROOM CONTAINMENT CENTER

[76] Inventor: Don A. Kleinsek, W5036N CTH A, Elkhart Lake, Wis. 53020

[21] Appl. No.: 949,605

[22] Filed: Sep. 23, 1992

[51] Int. Cl.[5] ..... B08B 15/02

[52] U.S. Cl. ..... 454/57; 312/1; 454/62; 454/187

[58] Field of Search ..... 312/1; 454/49, 56, 57, 454/61, 62, 187

[56] References Cited

U.S. PATENT DOCUMENTS

| | | | |
|---|---|---|---|
| 1,642,577 | 9/1927 | Carson | 454/56 X |
| 2,715,359 | 8/1955 | Mackintosh et al. | 454/62 X |
| 2,803,370 | 8/1957 | Lennard | 312/1 X |
| 3,115,819 | 12/1963 | Mahlmeister . | |
| 3,301,167 | 1/1967 | Howard et al. . | |
| 3,380,369 | 4/1968 | Allander . | |
| 3,410,619 | 11/1968 | Delnay et al. | 312/1 |
| 3,505,989 | 4/1970 | Truhan . | |
| 3,547,505 | 12/1970 | Ott et al. | 312/1 |
| 3,602,212 | 8/1971 | Howorth . | |
| 3,776,121 | 12/1973 | Truhan . | |
| 3,782,265 | 1/1974 | Pielkenrood . | |
| 4,016,809 | 4/1977 | Austin . | |
| 4,108,509 | 8/1978 | Piet et al. | 454/57 X |
| 4,111,753 | 9/1978 | Folsom et al. | 312/1 X |
| 4,197,646 | 4/1980 | Morrison | 454/57 X |
| 4,202,676 | 5/1980 | Pelosi, Jr. . | |
| 4,319,899 | 3/1982 | Marsh . | |
| 4,561,903 | 12/1985 | Blaul | 454/56 X |
| 4,682,448 | 7/1987 | Healey . | |
| 4,765,352 | 8/1988 | Strieter . | |
| 4,927,438 | 5/1990 | Mears et al. . | |
| 4,996,910 | 3/1991 | Howorth . | |
| 5,029,518 | 7/1991 | Austin . | |
| 5,112,373 | 5/1992 | Pham . | |

FOREIGN PATENT DOCUMENTS

| | | | |
|---|---|---|---|
| 650052 | 11/1964 | Belgium | 454/62 |
| 2130721 | 11/1972 | France | 454/57 |
| 2320502 | 3/1977 | France | 454/57 |
| 762121 | 11/1956 | United Kingdom | 454/57 |
| 2109921 | 6/1983 | United Kingdom | 454/57 |

OTHER PUBLICATIONS

Moody, J. R., "NBS Clean Laboratories for Trace Element Analysis," *Anal. Chem.*, 1982, 54:1358-1376.

U.S. Government, *Clean Room and Work Station Requirements, Controlled Environment,* Federal Standard No. 209b, Apr. 24, 1973.

U.S. Government, *Clean Room and Work Station Requirements, Controlled Environment,* Federal Standard No. 209D, Jun. 15, 1988.

1987 *HVAC Handbook,* Clean Spaces, 1987, 32.1-32.7.

Advertisement: PGC Scientifics, "Genesphere Mini Clean Room with UV Irradiation".

*Primary Examiner*—Harold Joyce

*Attorney, Agent, or Firm*—Ross & Stevens

[57] ABSTRACT

The clean room, which exceeds the Class 100 standards, constructed out of structural materials that are free of metal, in particular aluminum. The room is sterile and allows for a variety of manipulations to be performed including sensitive analysis steps. Intrinsic aluminum and most metal contamination is eliminated by constructing the clean room with aluminum free structural materials. Extrinsic contamination is prevented by following standard clean room procedures in a two-door positive pressure entry system under a single self-motorized ULPA filtered air flow. Analysis of samples is conducted under a vertical laminar ULPA filtered air flow at at least a Class 10 limit particle concentration standard. In addition, a clean room containment center wherein samples are prepared and processed inside a modular containment center that is under a negative pressure allowing a horizontal laminar ULPA filtered air flow that provides a Class 1 limit particle concentration rating.

18 Claims, 9 Drawing Sheets

CLEAN ROOM AND CLEAN ROOM CONTAINMENT CENTER

FIELD OF THE INVENTION

The present invention is directed to the field of clean room technology. Specifically, the present invention is directed to a clean room and clean room containment center designed to protect a sample or a piece of equipment from metal contamination from the outside environment, and to determine critical levels of metals in research samples.

DESCRIPTION OF THE PRIOR ART

The procedure for clean room operations can consist of a sequential series of steps: collection, storage, transfer, preparation, processing and testing of samples or equipment. Any of these steps can introduce potential sources of contamination from the air or interaction of solvents with structural materials and other materials used in the operation. This contamination problem is demonstrated no better than by irreproducibility and difficulty in the determination of precise low levels of aluminum, for example, especially in biological materials. This ubiquitous metal comprises 8.4% of the earth's crust and 1.5% of household dust and is present in most structural materials in clean room set-ups.

Because of the sensitive detection level required and the universal distribution of this metal, the concern for improved conditions for critical aluminum analysis has been stated many times in the literature and involves all components of the analysis procedure. Thus, aluminum presence is a good marker to test for the elimination of a particulate environment.

Important parameters for implementation of a clean room have been described (Moody, J. R., "NBS Clean Laboratories for Trace Element Analysis," *Anal. Chem.* 1982; 54:1358–1376; U.S. Government, *Clean Room and Work Station Requirements, Controlled Environment*, Federal Standard No., 209b, Apr. 24, 1973; 1987 *HVAC Handbook*, Clean Spaces, 1987:32.1–32.7). To reach the analytical blank for trace metal chemistry, i.e., zero level of trace metals in the environment, it is important to properly control the analysis environment. This includes the delivery of a particulate free environment in the clean room established by utilizing proper air flow patterns of desired air quality standards. In addition, structural materials are modified or replaced to suit the particular type of trace element that is analyzed. These two parameters are important especially with regard to the ubiquity of aluminum. In an attempt to address this problem, procedures have been devised to minimize sample handling and the number of reagents to be used while others have carried out their procedures under bags or acknowledged the presence of aluminum in the equipment used as a complicating factor. Procedures of this type are not only restrictive, cumbersome and time consuming, they also provide no guarantee to eliminate the contamination of the analytical blank.

SUMMARY OF THE INVENTION

An object of the present invention is to provide a clean room environment which exceeds a Class 100 rating.

Another object of the present invention is to provide a working space which protects a sample or an object from metal contamination from the environment, the operator, apparatus, container or reagents.

It is also an object of the present invention to provide a clean room and clean room containment center design which can determine critical levels of aluminum with important application in biology and medicine.

The present invention is directed to a clean room having at least about a Class 100 limit particle concentration standard comprising a substantially-metal free chamber having a ceiling, sidewalls depending from the ceiling and a floor. The chamber includes an anteroom and a laboratory room. The anteroom and the laboratory room are separated by a dividing wall positioned inside the chamber. The dividing wall includes means allowing passage from one room to another. The anteroom and laboratory room form a positive pressure entry system. The clean room also has an air blower means for blowing air into the chamber and a filtering means for filtering particles from air entering the chamber. The filtering means effectively provides at least about a Class 100 limit particle concentration standard. Further, there is an exhaust means for discharging filtered air from the chamber.

The present invention is also directed to a method for constructing a clean room chamber described above from an existing room having a ceiling, sidewalls and a floor. The method includes removing substantially all metal or metal particles from the room, maintaining an environment substantially free of dust and dirt particles and residues during the construction process, insulating the walls, installing clean room wall panels on the room walls, the wall panels being substantially dust and dirt free, providing filter and exhaust means, providing a clean room ceiling and floor, wherein the clean room wall panels depend from the clean room ceiling and floor, and providing sealed surface transitions between the clean room ceiling, walls and floor.

The present invention is also directed to a clean room containment center having at least about a Class 100 limit particle concentration standard designed to be placed on a relatively horizontal surface comprising a modular substantially transparent box having substantially metal-free parts. The box has a ceiling, a front wall, a back wall and side walls, wherein each of the walls depend from the ceiling. The box also includes at least one iris arm port in the front wall of the box and at least one entrance door. The containment center further includes an air exhaust for creating a negative pressure into the chamber, a filtering means providing a horizontal laminar filtered air flow at at least a Class 100 limit particle concentration standard, and exhaust means.

The present invention is also directed to a clean room and clean room containment center combination comprising a clean room chamber and a clean room containment center, as described herein.

An important advantage of the present invention is that design of the clean room and clean room containment center provides a relatively inexpensive, convenient, efficient, and safe facility, which is virtually metal free, to conduct desired research.

Class Ratings: Class ratings for air quality are derived from analysis of the air quality in a defined environment and are defined as the maximum number of particles 0.5 μm or larger occupying one cubic foot of space. For example, a Class 1000 limit particle concentration standard (or Class 1000 standard) means that there are approximately 1,000 particles 0.5 μm or larger in a cubic foot of air in a defined environment. The class rating for normal air is approximately 100,000. The clean room of the present invention provides a sterile environment exceeding a Class 100 standard. This is due to an efficient air flow design requiring only one small, inexpensive, self-motorized ULPA filter unit to provide Class 100 conditions for the entire area. The anteroom and the laboratory room will operate under a differential positive pressure to prevent outside air from entering the clean room air space, and together the total airspace will meet the clean room rating of class 100. A detailed description of class ratings is found in *Clean Room and Work Station Requirements, Controlled Environment* (U.S. Government, Federal Standard No. 209D, Jun. 15, 1988, which is incorporated herein by reference).

The containment center will have many varied uses that requires a sterile environment at at least a Class 10 standard.

Having met the stringent criteria for an analytical clean room, the clean room will have many varied uses that requires a sterile environment at a Class 100 standard. Examples include hospital surgery rooms, processing, manufacturing and testing of pharmaceuticals, cosmetics, foods and beverages, equipment including electronic, computers and components, biologicals including microbiological and molecular biologicals such as polymerase chain reactions (PCR), and any manipulation that requires a large, sterile and free working area. The room will have analytical use for trace metals such as aluminum as well as other inorganics and organics.

The clean room and containment center are relatively inexpensive due to the design and easy accessibility and low cost of construction material and component parts. For example, the melamine panels and RTV silicone which can be used for the inner, closed environment of the clean room are inexpensive products available on the retail market. The melamine walls also provide for a very slick surface which retards dust buildup and are very chemically resistant, as is the silicone caulk.

Additional advantages over other designs is the use of the highly efficient self-motorized ULPA filter which removes the need for large and costly (initial and operating cost) air handlers. The ULPA filter improves the efficiency of particle removal compared to HEPA filters. The air flow pattern and component parts provide for surrounding ambient temperature and humidity control without implementing special heat, cooling or humidity equipment. Due to the air flow design and efficient forward curved blower assembly of the ULPA filter unit, the room runs very quietly.

The containment center has uses in any process that requires a clean atmosphere to work in. In contrast to clean rooms, the containment center provides a cleaner and smaller area to work in. The containment center will have many varied uses that requires a sterile environment at at least a Class 100 standard, preferably exceeding a Class 10 standard, and more preferably approaching a Class 1 standard. Examples include hospital surgery rooms, processing, manufacturing and testing of pharmaceuticals, cosmetics, foods and beverages, equipment including electronic, computers and components, biologicals including microbiological and molecular biologicals such as PCR reactions, etc., and any manipulation that requires a sterile and smaller working area than a clean room.

The containment center is safe because it isolates the operator and the outside environment from fumes or biological pathogens due to a 100% exhaust to outside the building or a particular work area.

The containment center is inexpensive due to its simplistic design and accessible materials. It is also convenient and can be placed on top of any lab bench. The dimensions of the containment center can be altered to meet the operator's needs. Further, it can be made portable by placing wheels on the supporting cabinet. The shape and dimensions of the center is a convenient working height and depth and provides for easy viewing.

The containment center is easy to work in, allowing nominal operator interference with easy viewing and inside access and relaxing body positions in sitting or standing positions.

The elliptical shape of the iris ports and the two-fold thickness of gum rubber canvassing the ports are superior to glove arm ports or circular ports or manyfold thicker rubber coverings for general maneuverability and speed of operations without any noticeable leakage of outside laboratory air.

The acrylic box is chemically resistant and provides clear viewing. With proper thickness, the box provides structural strength. Easy cleaning of outside dust is afforded through the contour of the containment center and acrylic material.

Preferential portions of the inside of the containment center can be vented due to the adjustable faceplate that prevents cross contaminating airflow of areas inside the containment center.

A double-door transition box allows for exiting of samples without leakage of outside air back into the containment center.

Like the clean room the containment center is also very efficient. The use of this type of ULPA filter, as opposed to the HEPA filter, is effective in filtering smaller particles of 0.12 microns (down to virus level) whereas the HEPA only functions at a 0.3 micron rating or higher. The ULPA filter is 99.9995% efficient, more than most filtration media. The ULPA filter conserves on space, due to its 2 in. dimple pleated contour of medium versus 6 in. in other type of filters available.

The variable speed exhaust system allows for ready increases in air flow to flush out spills or for other emergency operations.

The airflow at 90 cubic feet per minuter (cfm) provides a laminar clean air flow proceeding from the right to left of the containment center. This provides for convenient hand, sample and equipment placements and manipulations that prevents cross-contamination. The horizontal air flow deeps contaminants from entering apertures such as the top of tubes. In contrast, vertical airflow is conducive to this type of contamination and requires very astute manipulations to avoid. In addition, a vertical laminar flow requires a full-length exhaust plenum and filters across the containment center.

The horizontal air flow provides for a simplistic and effective working process of contaminating to cleaner air in the work direction of left to right.

Further objects, features and advantages of the invention will be apparent from the following detailed description when taken in conjunction with the accompanying drawings.

DETAILED DESCRIPTION OF THE INVENTION

The present invention will be described with respect to its analytical use of a common metal contaminant aluminum and its elimination from a research environment. However, the use of the clean room and containment center for analytical use of other trace metals and as well as other inorganics and organics is well within the scope of the present invention since the structural materials are chemically resistant to most inorganic and organic solvents.

In order to protect the work space from airborne or laboratory-induced contaminants all structural material and apparata should be substantially metal free unless a compromise is otherwise noted. Thus, the construction materials should not only be metal free but also structurally strong and durable as well as chemically resistant to reagents used in the clean room. This type of scrutiny produces a clean room that has applications beyond trace metal chemistry but for use with organic or inorganic solvents.

As a general rule, plastics are substituted for metals whenever feasible. Any metal, such as stainless steel or brass parts, considered for use should contain either very low or negligible amounts of aluminum. Any exposed metal surfaces must be painted with aluminum free enamel or epoxy paint. Painting effectively places items outside the laboratory environment.

Figure 1:
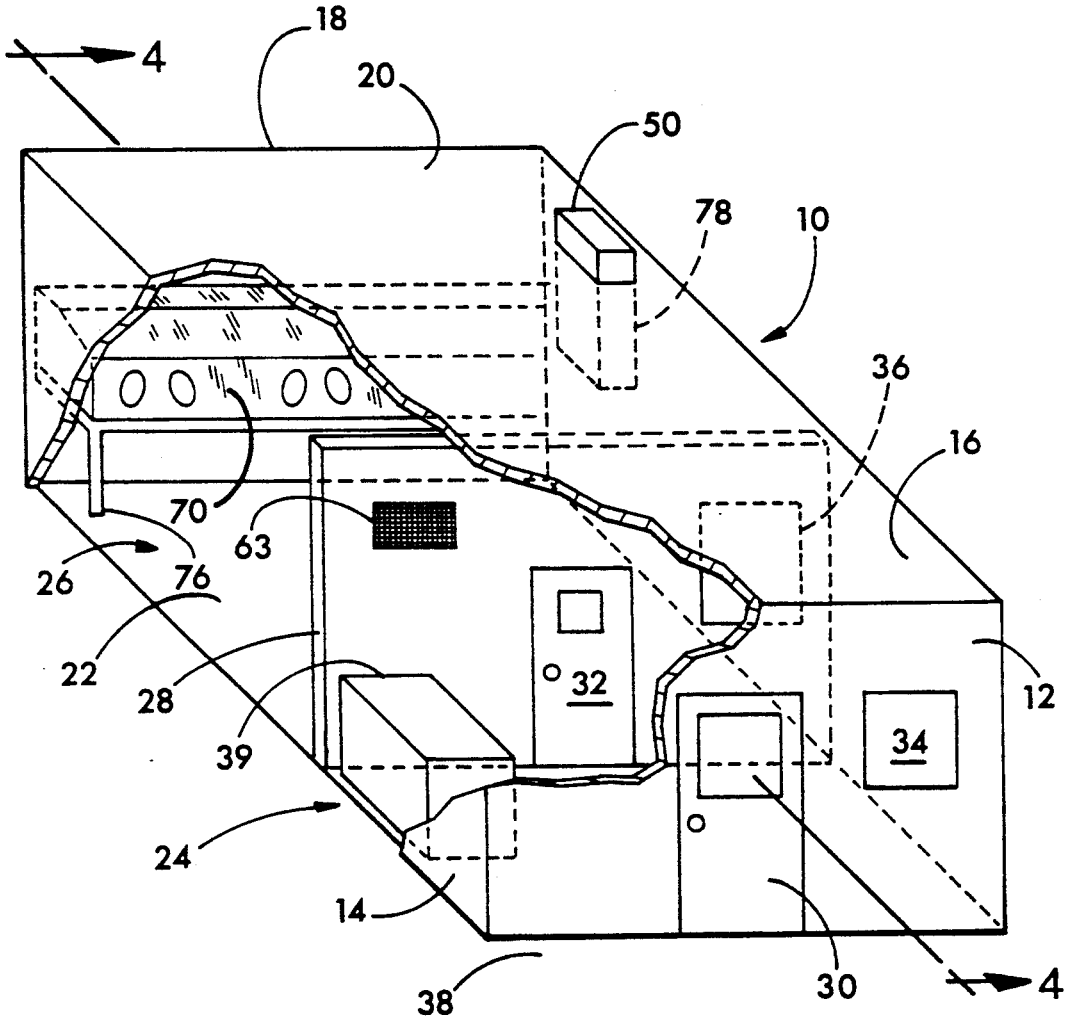
FIG. 1 is a partially cut-out perspective view of the clean room of the present invention.
Figure 2:
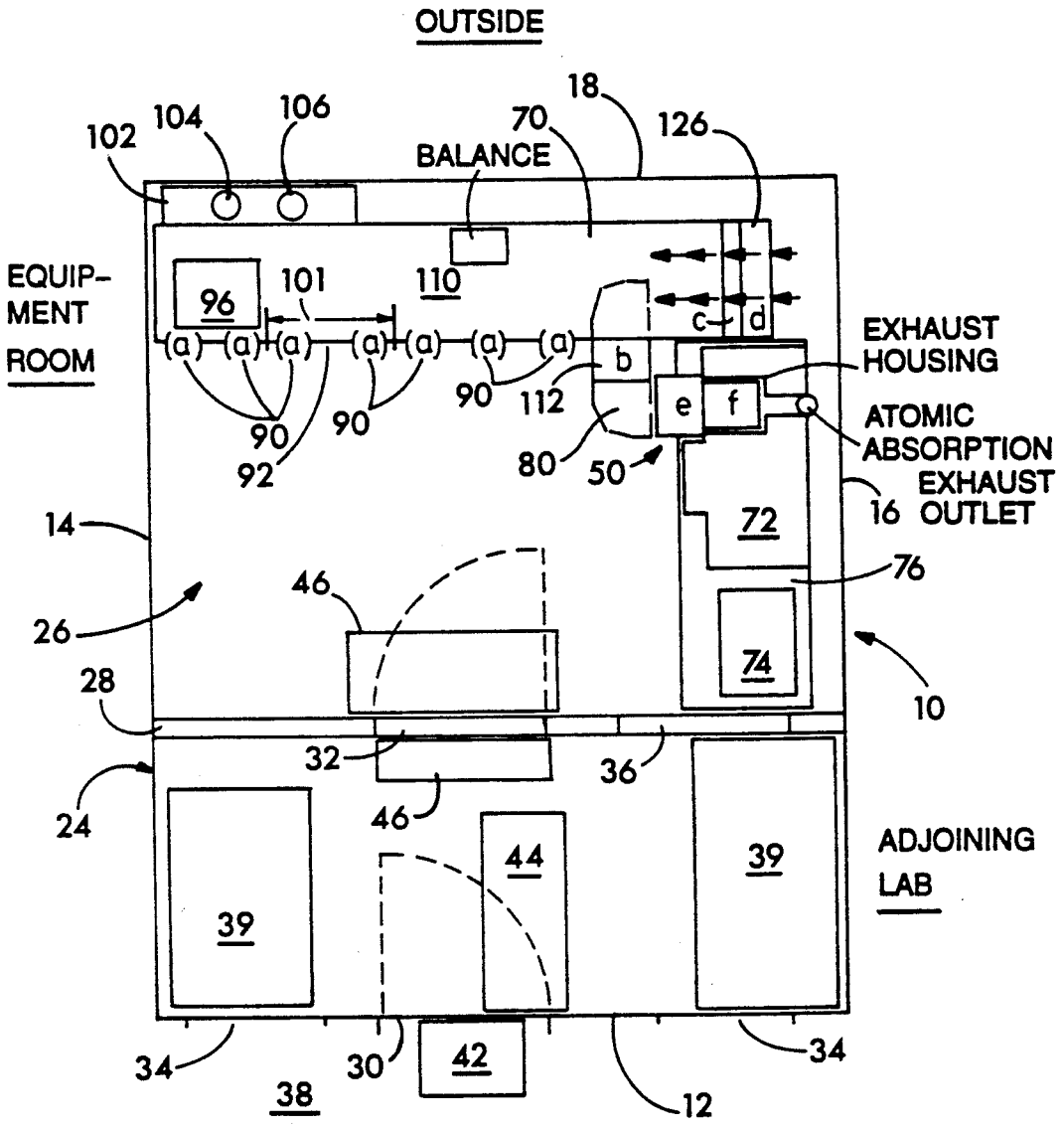
FIG. 2 is a top schematic view of the clean room of FIG. 1.

Referring to FIGS. 1 and 2, there is shown a preferred embodiment of the clean room structure of the present invention, generally designated by reference number 10. The clean room 10 comprises a plurality of walls including a front wall 12, two side walls 14, 16 respectively, and a rear wall 18. The clean room also includes a ceiling 20 and a floor 22. The clean room 10 is divided into an anteroom 24 and laboratory room 26 by a dividing wall 28. Both the front wall 12 and dividing wall 28 are provided with entrance doorways 30, 32 respectively. If desired, both walls 12 and 28 may also be provided with viewing windows 34, 36 respectively.

As shown in FIGS. 1 and 2, the anteroom 24 may be used as a partition between the outer hallway 38 to laboratory room 26, as a changing area for personnel donning clean room laboratory clothing, and as an office for clean room personnel to conduct paperwork and telephone calls. Desks and other furniture, generally designated by reference number 39, may be located inside the anteroom 24. A turf mat 42 may also be placed in front of the front anteroom door 30 for removal of gross dirt from the bottom of shoes. Immediately upon entering the anteroom 24, an adhesive "tacky" mat 44 is desirably placed to pick up any fine dirt from the soles of shoes.

Figure 3:
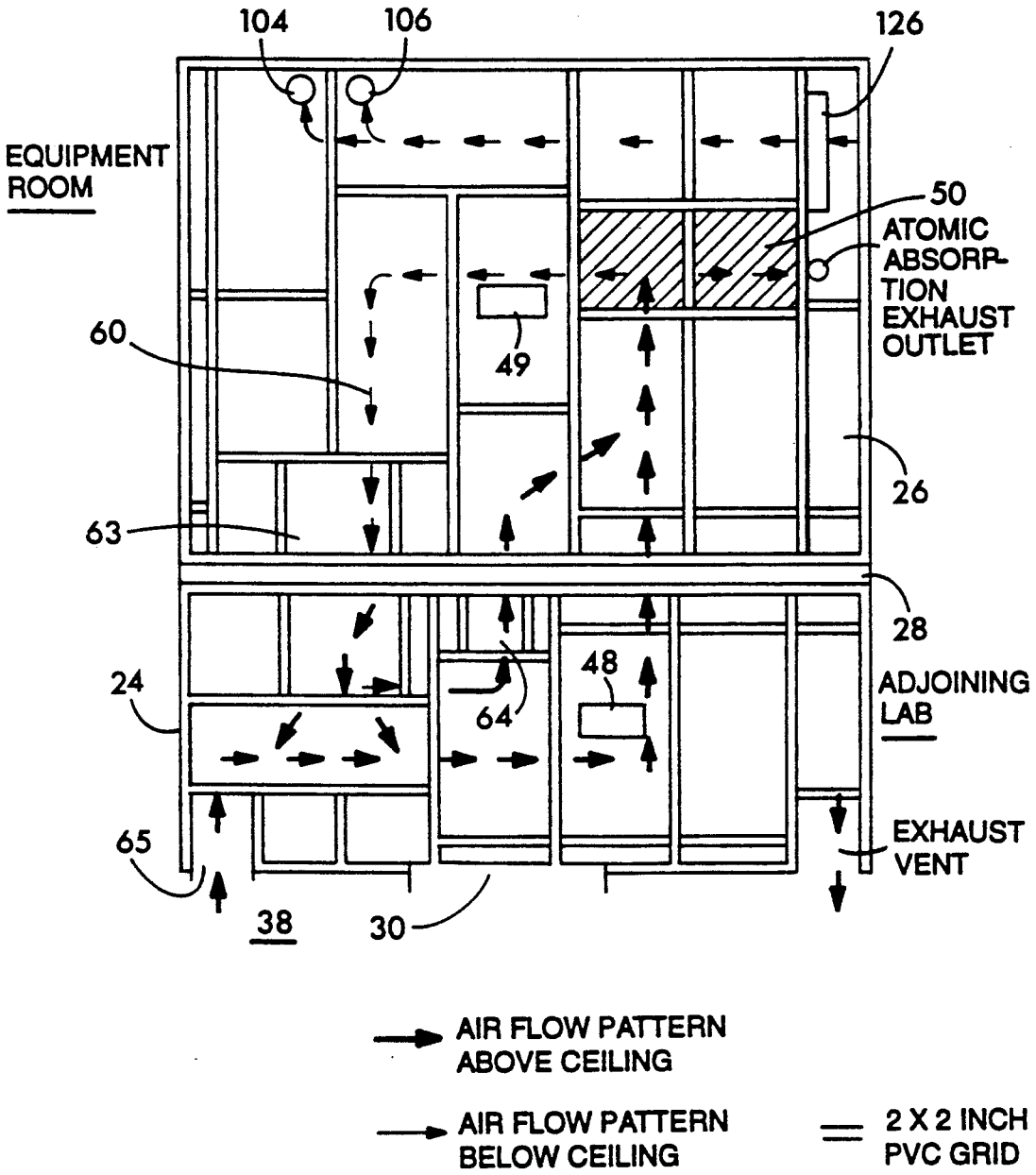
FIG. 3 is a top schematic view of the clean room of FIG. 1 illustrating the air flow pattern above and below the ceiling.

Upon entering the laboratory room 26, a second tacky mat 46 may be placed to ensure removal of any residual particles. One four-lamp fluorescent light 48 may be located near the center of the anteroom 24 to provide sufficient lighting (3200 lumens) for the anteroom 24 as illustrated in FIG. 3.

The laboratory room 26 is where all preparation, processing and analysis of samples are carried out. This room is also preferably lighted by a central four-lamp fluorescent light fixture 49.

The laboratory room contains a highly efficient filtering system 50, which is located in the ceiling 20. The filtering system 50 provides an efficient air flow design requiring only one relatively small, inexpensive, self-motorized ULPA filter unit to provide at least Class 100 conditions for the entire area.

The preferred filtering system 50 is a variable speed, self-motorized ULPA (Ultra Low Penetration Air) filter unit (Comp-Aire, Grand Rapids, Mich.). The preferred filter is a 2 in. separatorless ULPA VSLI ® filter purchased from Flanders Filters, Inc., Washington, N.C. This filter consists of a 2 in. compact, dimple-pleated medium that is equivalent to the same amount of pack medium contained in 6 in. separator-type filters. It is within the scope of the present invention to use other ULPA filters or filters which operate at an efficiency of about 99.97% on 0.3 micron or larger particles.

This filter is assembled into an all cold-rolled steel housing and was coated with baked-on powder polyester urethane, as is the blower unit including the damper and plenum hood. The direct drive, forward curve centrifugal type fan is powered by a motor with a steel end bell in lieu of an aluminum end cap standard motor and is rated at ⅓ HP, 120 volt, single phase, 60 Hz. (A. O. Smith, Tipp City, Ohio). The ULPA filter unit can deliver up to 950 cfm of air at 1 in. static pressure and operates at an efficiency of 99.9995% on 0.12 micron or larger particles. The polyester air 2 in. thick pre-filter pad with a 89% arrestance factor and 180 gram dust holding capacity was obtained from Airguard Industries Inc., New Albany, Ind.

The filtering system 50 removes the need for large and costly (initial and operating cost) air handlers. The ULPA filter improves the efficiency of particle removal compared to HEPA filters. The air flow pattern and component parts provide for surrounding ambient temperature and humidity control without implementing special heat, cooling or humidity equipment. Due to the air flow design and forward curved blower assembly of the ULPA filter unit, the room runs quietly.

The anteroom 24 and the laboratory room 26 will operate under a differential positive pressure and together the total airspace will meet the clean room rating of Class 100.

The components of the airflow consist of a variable speed, self-motorized ULPA filter in the filtering system 50, plastic air intake and relief housing and grills and flexible ducts supported by saddle polyester straps (not illustrated). The solid-state variable speed control adjusts and maintains the desired airflow through the ULPA filter. The ULPA filter is preferably designed to avoid aluminum containing parts. This includes the particle board frame ULPA containing a separatorless medium. The forward curve blower-motor assembly consists of baked on enamel coated steel and runs quietly.

Figure 4:
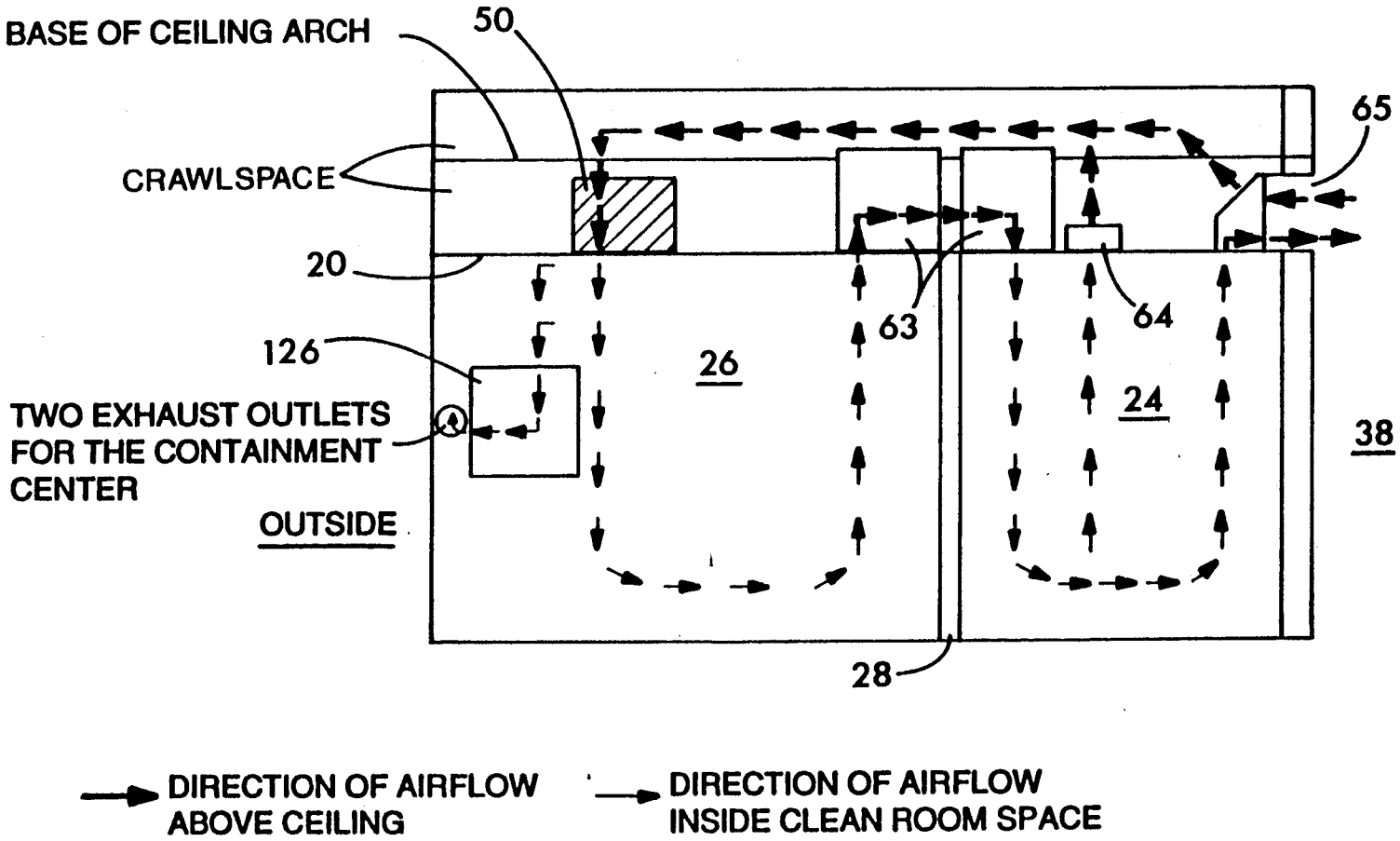
FIG. 4 is a side cross-sectional view of the clean room of FIG. 1 taken along lines 4–4 of FIG. 1.

As illustrated in FIGS. 3 and 4, this design provides an air flow pattern that keeps particulates out of the clean room space by creating a positive pressure with filtered air. The air flow provides about 60 air changes per hour for both the anteroom and laboratory space. The differential pressure, given in inches of water, is 0.090 between the laboratory room 26 and the anteroom 24 and 0.045 between the anteroom 24 and the hallway 38. This results in a two-door positive pressure entry system effective in minimizing airborne particulates from entering the clean room space. The filtered air passes from the laboratory 26 to the anteroom 24 via an intake/exhaust grill 63 illustrated in the dividing wall 28 in FIG. 1 or alternatively in the ceiling 20 in FIG. 4. A return grill 64 located in the anteroom 24 is used for removal of air back into the laboratory room 26 by passage through the ULPA filter system 50. If desired, each of the grills 63, 64 may be fitted with a filter attachment such as a prefilter to prevent particles flowing through the grills. Its main function is to guarantee a relative negative pressure of the anteroom 24 in relation to the laboratory room 26 and this return air comprises only about 20% of the intake air for the laboratory room 26.

The remaining 80% of intake air is obtained from the building hallway space through hall filter 65. Since the self-motorized ULPA filter 50, which is capable of delivering 1,000 cfm, is the sole air handler source for the clean room 10, the air must be conditioned with respect to humidity and temperature. This is accomplished by regulating the total clean room exhaust to circulating air ratios, which is 1:1.25 for the clean room space. This represents a fresh air change every seventy-five seconds. Thus, there is a near complete fresh air exchange per air change. This type of air circulation ensures that the clean room atmospheric conditions are the same as the rest of the building. Utilizing this ambient conditioned air removes the initial and operating cost of, the space required by and the potential contamination of aluminum that is present in most other types of air handlers.

Preparation of Clean Room Space

All preexisting equipment, furniture, electrical, extraneous plumbing and heating fixtures, and ventilation ducts in the space chosen for renovation into the clean room quarters are removed. The space that remained consisted of four bare walls, an arched ceiling with one ventilation hole to the roof, a floor with a central drain, and water and heating lines on the outside wall. This space will be effectively sealed off from the interior of the clean room during its construction. However, to promote a cleaner environment for the construction of the clean room interior, this exterior space is further prepared as clean and aluminum free as described below.

Any aluminum containing paint in the cement floor is removed. If necessary, the walls and ceiling are cleaned, preferably steam cleaned. Any metal pipes in the clean room area, which may carry hot and cold water, are painted over with the paints described. Where possible, water is delivered through a CPVC line. Dual PVC drains connecting to a back wall drain are installed. Openings through the exterior wall for air intake and exhaust grills to the exterior must be formed. The entire ceiling and walls are conditioned to a metal-free environment such as by enamel paint. Throughout these steps and at the end, the room is vacuumed. This type of precaution minimizes dust or aluminum containing paint chips from entering the interior of the clean room during its construction.

Construction of the Clean Room

As shown in FIG. 1, the dimensions of the particular working space in this example is 16 feet long by 12 feet wide with a height of 10 feet, 4 inches to the top of the arch ceiling and 9 feet to the base of the arch beams (the beams are 3¼ inches (in.) wide and separated by 26½ in.). The interior clean room space will consist of an anteroom 24 (11 ft. 8 in.×5 ft. 2 in.×7 ft. 3 in. high) and laboratory 26 (11 ft. 8 in.×9 ft. 6 in.×7 ft. 3 in. high) separated by a 5 in. interior wall 28.

During all phases of the construction, care should be taken to keep the environment clean of residues by wet mopping, vacuuming and isolation of construction areas. The initial step is to insulate the outside wall with a 1 inch styrofoam base before installing a build-out frame comprised of 2 in.×4 in. lumber on the west wall. This allows 8 in. between the clean room wall and insulation to accommodate the water and drain lines to the clean room laboratory. Next, 2 in.×4 in. lumber furring strips with 12 in. centers and 2 in. depth are fastened around the perimeter of the clean room space with concrete nails and an aluminum-free room temperature vulcanization (RTV) silicone sealant. A solid electrical PVC conduit is then fastened onto the wall above the 8 ft. furring strips with RTV silicon adhesive and branched between the furring strips to designated electrical PVC outlets located 2 ft. from the floor. The covering to the outlets are mounted to the box using nylon fasteners and are flush with the interior wall. Aluminum grounds in the wiring are avoided.

The interior framework with door and view window cutouts consist of 2 in.×4 in. lumber covered with ¼ in. plywood and are installed with concrete nails and RTV silicone.

Melamine panels (Afco Industries, Inc., Alexandria, La.) are next installed around the perimeter furring strips and frames with properly measured and cut reliefs to accommodate outlet boxes, phone jacks, plumbing lines and an access panel to the plumbing and drain lines. The panels are a high-pressure white enameled coated masonite, ⅛ in. thick and are joined together with PVC channels. RTV silicone is used to adhere the panels to the furring strips and channels. The surface of this panel is smooth, not granulated and thus is less likely to accumulate dust. It is easy to clean and maintain and exhibits good resistance to most chemical reagents. This represents the interior walls to the clean room space. Advantageously, these panels provide a structurally strong interior wall for the chamber. Because of their thickness, the panels are also easy to cut and manipulate for placement on the clean room walls. The silicone is an effective, yet simplistic, means of sealing the panel structures.

The wood door frame, PVC floor and frame thresholds for the doors, the acrylic windows and surrounding PVC window sill and door jam trim are installed. The trim, sill and wood doors are painted to a smooth finish and polyurethane coated before installation. The window is caulked into its plastic framework, the door trim is caulked onto the doorframe and the solid core wood doors are hung onto painted brass hinges. The doors have brass knobs and tumbling mechanism. Both the entry door to the office and laboratory are sealed with weather stripping around the doorframes and have a sweep attached to their interior side, which does not touch the floor in the open position but rests upon the plastic threshold in the closed position.

The 7 ft. 3 in. drop ceiling is next installed with custom made PVC gridwork. The perimeter of the ceiling consists of 2 in. angle in which the leg above the ceiling is fastened through the wall panel into the furring strips and frames by brass screws and RTV silicone. The main runners and cross tees are comprised of 2 in.×2 in. T profiles and were installed flush to the angle and each other by a fabricated notch and PVC glue assembly. The ceiling gridwork (Gehr Plastics, Inc., Aston, Pa.) is suspended by nylon ties attached from the top rib of the T profiles and coupled into brass hangers fastened in the concrete ceiling. The gridwork's dimensions are tailored to accommodate the 2 ft.×4 ft. ULPA filter frame, light fixtures and lay-in melamine panels as well as the varied sizes for air relief and return heating, ventilation, air conditioning (HVAC) grills. All these components are sealed onto the gridwork with RTV silicone as they were added to the clean room. For aesthetic reasons silicone is applied to the topside of all panels except for one. This one panel is caulked from the underside to allow easier access, if needed, to the crawlspace above the false ceiling.

The two light fixtures each have four fluorescent bulbs that are plastic end-capped and are contained within a gasketed acrylic diffuser. The housing is made of a cold-rolled steel that was enamel painted. The air return and relief grilles are made of polyvinyl chloride (PVC) (Marley Moulding, Marion, VA) and are connected by ducts (Flexible Technologies, Abbeville, S.C.) located in the crawlspace area as shown by the airflow pattern described in FIG. 4. The separatorless ULPA media faces the clean room space whereas its particle board frame is functionally outside the clean room interior.

After all ceiling work is completed, the floor is installed. This first requires a leveling of the floor surface with concrete. Then the smooth surfaced vinyl floor, which is free of clay or silicate fillers and has good chemical resistivity, is laid down onto the concrete with a coat of flooring adhesive. The large sections of floor are fused together by heat. This process produces a smooth, non-dust collecting seam. Next the baseboard was installed with the top and bottom edges sealed with clear RTV silicone (Red Devil, Inc., Union, N.J.). This creates a smooth coved surface transition between the floor and walls and aids in the retardation of the dust buildup.

Particle counting: Particle distribution measurements were performed with a Model 5230 Microair airborne particle counter couple with a Model 172 Pacific Scientific aerosol sampling probe. Class ratings for air quality were derived from the analysis and are defined as the maximum number of particles 0.5 μm or larger that occupies one cubic foot of space.

The Clean Room Containment Center

As illustrated in FIGS. 1 and 2, the laboratory room 26 may be designed to accommodate a containment center 70 as well as other pieces of machinery. For example, as illustrated in FIG. 2, the laboratory room may contain an atomic absorption spectrophotometer 72 and a printer 74. Both of these items are placed on top of laboratory cabinets in an L-shaped support structure 76. The power supply for the spectrophotometer 72 is supported on a lower shelf (not illustrated).

The ULPA filter system may be enclosed by enclosure curtains 78, illustrated in FIG. 1, which are positioned down to working height. At this functional point of use the air change is about 1800 per hour and the air quality rating exceeds the class 10 limit particle concentration standard. This is accomplished by the airflow pattern 60 as indicated in FIG. 3. The laminar air flow may then be delivered over the spectrophotometer 72, the transition box of the containment center 70 and a 2 ft.×2 ft. adjacent space 80 for operator occupancy.

The atomic absorption readings are performed under a vertical laminar airflow delivered from the filter system 50 in which curtains 78 are attached to its frame and extend down to the working surface.

Containment Center

For most uses, the clean room 10 can be operated independent of the containment center 70. The containment center 70 provides a smaller working area and a sterile environment that is greater than a magnitude cleaner than the clean room, i.e., approaching Class 1 versus Class 100 for clean rooms. The containment center 70 is modular and hence mobile and can be operated outside the clean room in an ordinary atmosphere to obtain sterile working conditions.

The containment center 70 is designed to rest upon the support structure 76. The support structure may have attached wheels for easy movement of the containment center 70. The length, as well as the depth of the center 70 can be changed depending on the use it is intended for. Referring now to FIGS. 5–10, the containment center 70 includes a generally pentagon shaped transparent enclosure or box 80 that is preferably made of ⅜ in. thick acrylic or similar material such as polycarbonate. The box 80 is thick enough to prevent implosion due to negative pressures generated inside the center 70 and is still thin enough for easy fabrication and weight considerations.

The box 80 is designed to align with the top of the support structure 76. Preferably the support structure 76 has an open architecture to prevent any dust accumulation.

The box 80 includes a backside 82, a generally 45° angled downslope front face 86 that allows for an uninterrupted and convenient view of work and ends with a vertical face drop 88 to the base panel 89. The contour of the downslope 86 and slickness of the acrylic material retards dust accumulation on the outside of the viewing area.

Access to the inside of the containment center is through elliptical iris arm ports 90 that are preferably about 8¾ in. high by 6½ in. wide with an inward slant consistent with human arm movement. The elliptical shape of the iris ports 90 and the two-fold thickness of gum rubber canvassing the ports are superior to glove arm ports or circular ports or manyfold thicker rubber coverings for general maneuverability and speed of operations without any noticeable leakage of outside laboratory air. The two-fold rubber covers 91 over the elliptical ports 90 are each provided with slits 93. The slits 93 of each cover 91 are positioned at angles, preferably right angles, to each other to inhibit the entry of particles through the ports 90.

Placement of instruments and samples is done through the acrylic front entrance door 92 which is hinged and gasketed and forms a tight seal using wing clips 94. Two iris ports 90 may be attached to the 26 in.×11 in. door 92. The shape, dimensions and height of this containment center are sufficient to maneuver and accommodate the sample preparation and processing steps.

Figure 5:
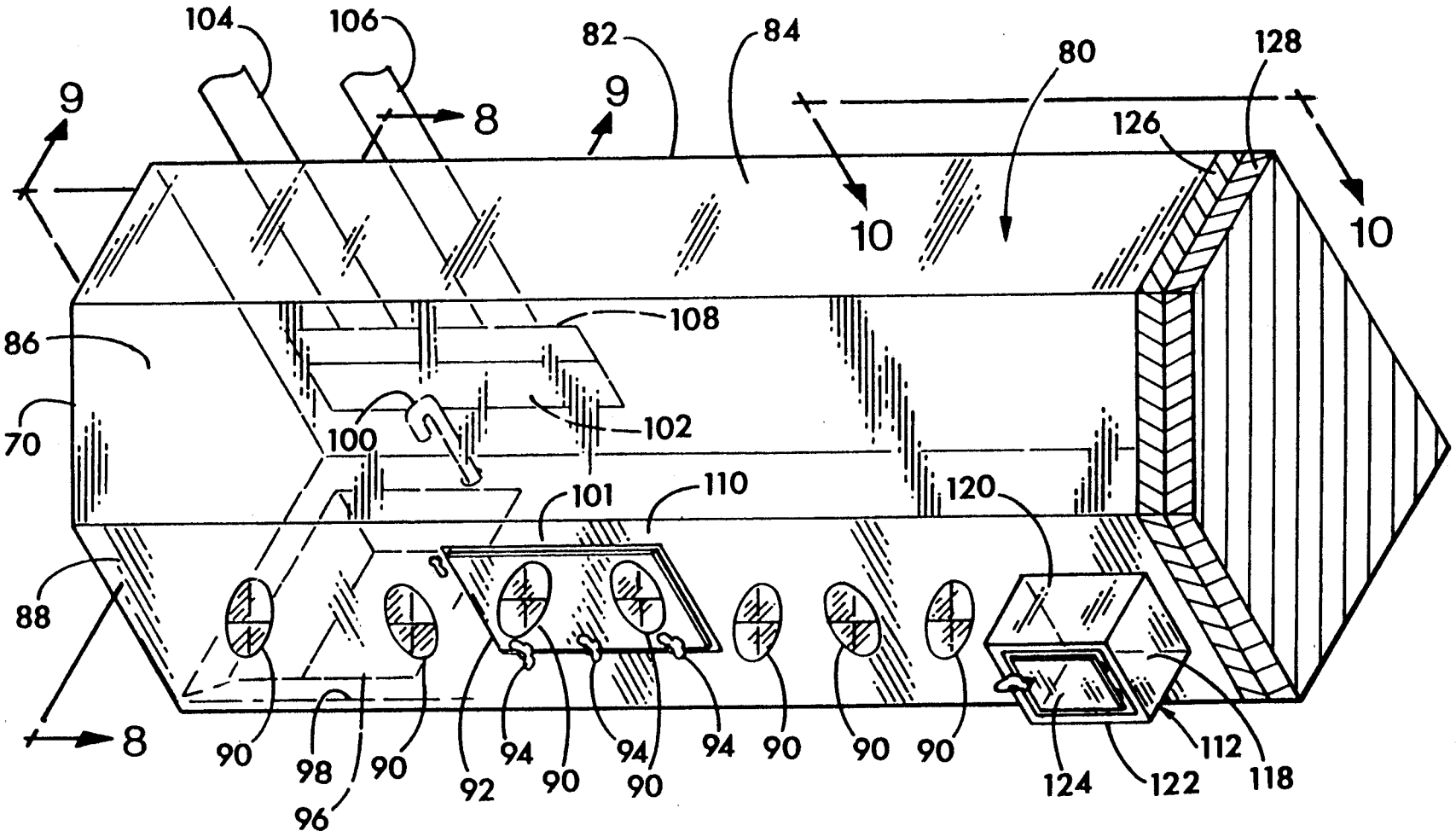
FIG. 5 is a perspective view of the clean room containment center of the present invention.
Figure 6:
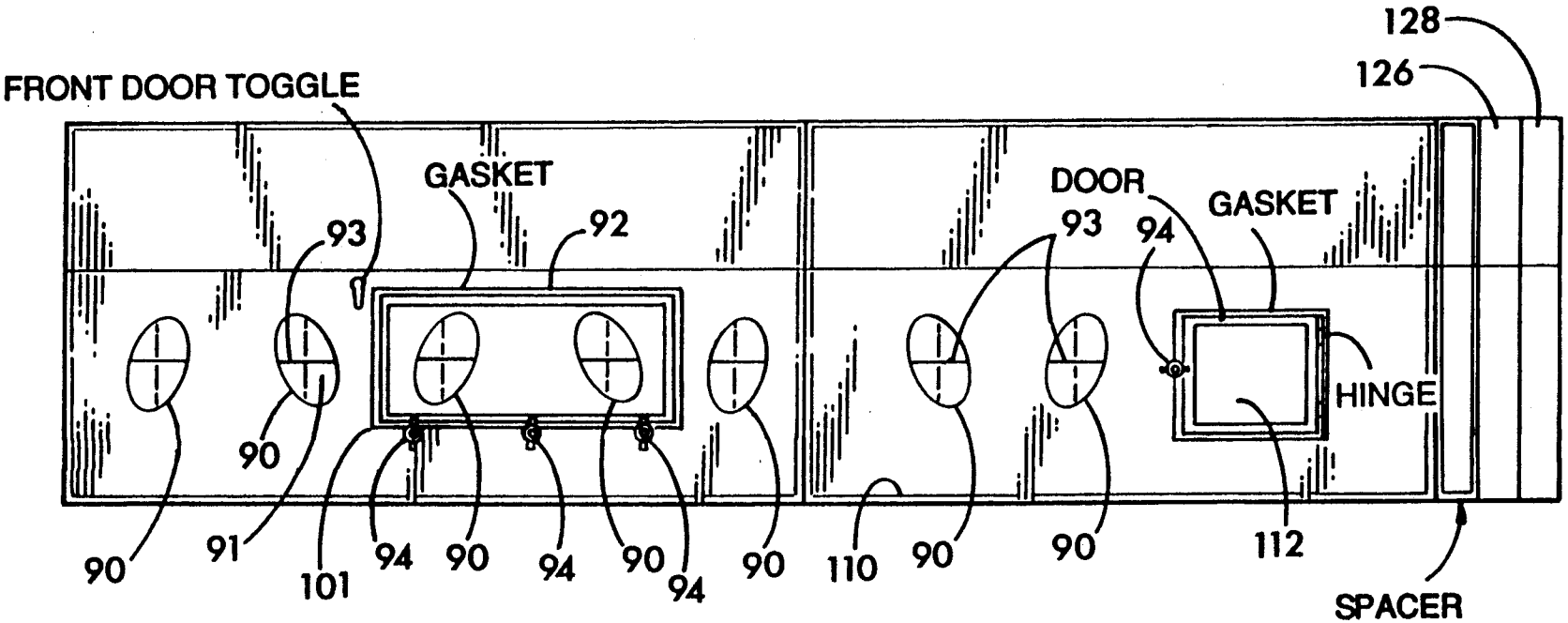
FIG. 6 is a front plan view of the containment center of FIG. 5.
Figure 7:
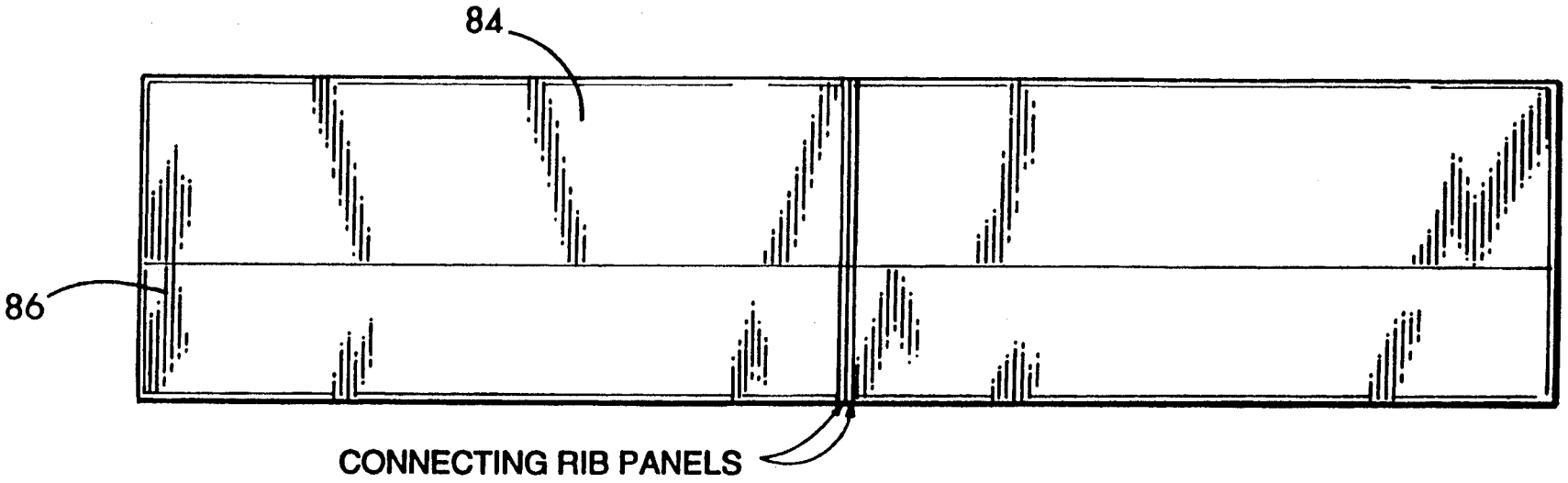
FIG. 7 is top plan view of the containment center illustrating a modular construction as an alternative embodiment.

The containment center 70 may be designed to include the following features and are described in a work process direction from left to right as illustrated in FIGS. 5 and 6. A sink 96 can be incorporated into the containment center for washing and cleaning of samples or other work that requires aqueous or caustic solvents. The sink is 18 in.×12 in.×12 in. deep, made of high-density polyethylene and contains a PVC plug, trap and drain. Stainless steel sink and drain lines can be used with organic solvents.

Placed around the perimeter of and on top of the ⅛ in. thick lip of the sink are acrylic slabs 98 that extend 3½ in. from the containment center wall to the sink basin with a slight downslope. This permits easy drainage of any spills or splashing of liquids. The back slab surrounds water faucets 100 that provide hot, cold and deionized water. The faucets can be fabricated of PVC, but for durability reasons enamel coated brass faucets with an internal polyethylene liner can be used. The water supply is piped from outside lines to the faucets attached to the counter top of the cabinet the containment center rests upon. An iris acrylic port with a twofold thickness of gum rubber and an acrylic glove port with a 15 mil thick neoprene glove arm (not illustrated) may be located in front of the sink basin. The glove arm is used for contact with concentrated acids.

Figure 8:
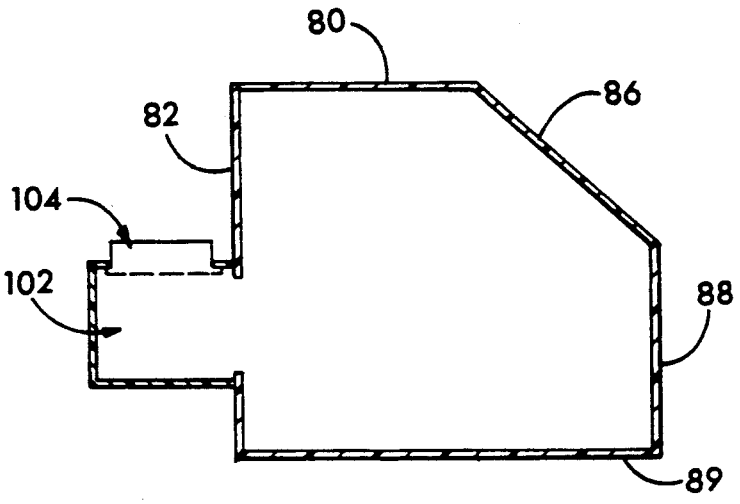
FIG. 8 is a side cross-sectional view of the containment center of FIG. 5 taken along lines 8—8 of FIG. 5.
Figure 9:
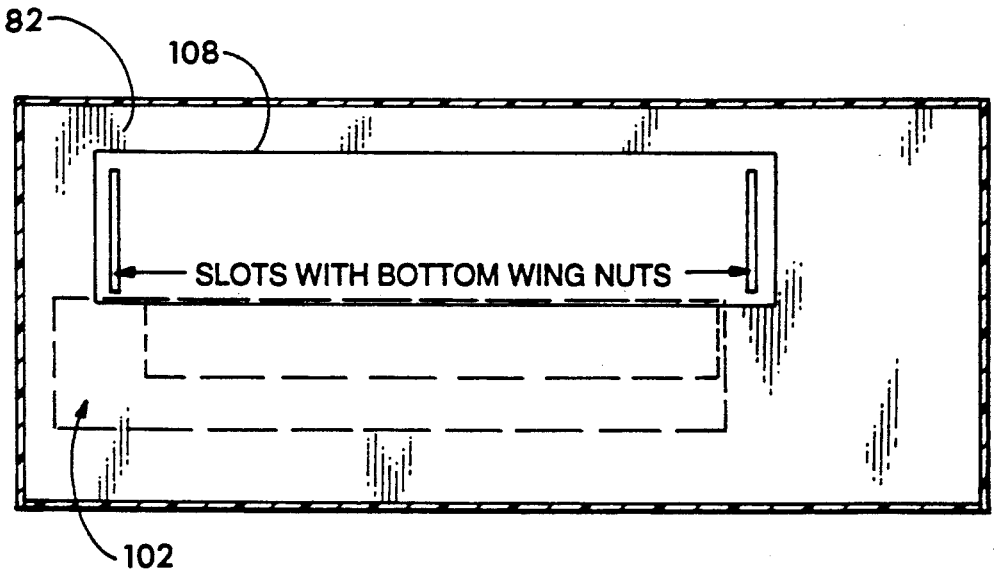
FIG. 9 is a front plan view of the exhaust system of the containment center of FIG. 5 taken along lines 9—9 of FIG. 5.
Figure 10:
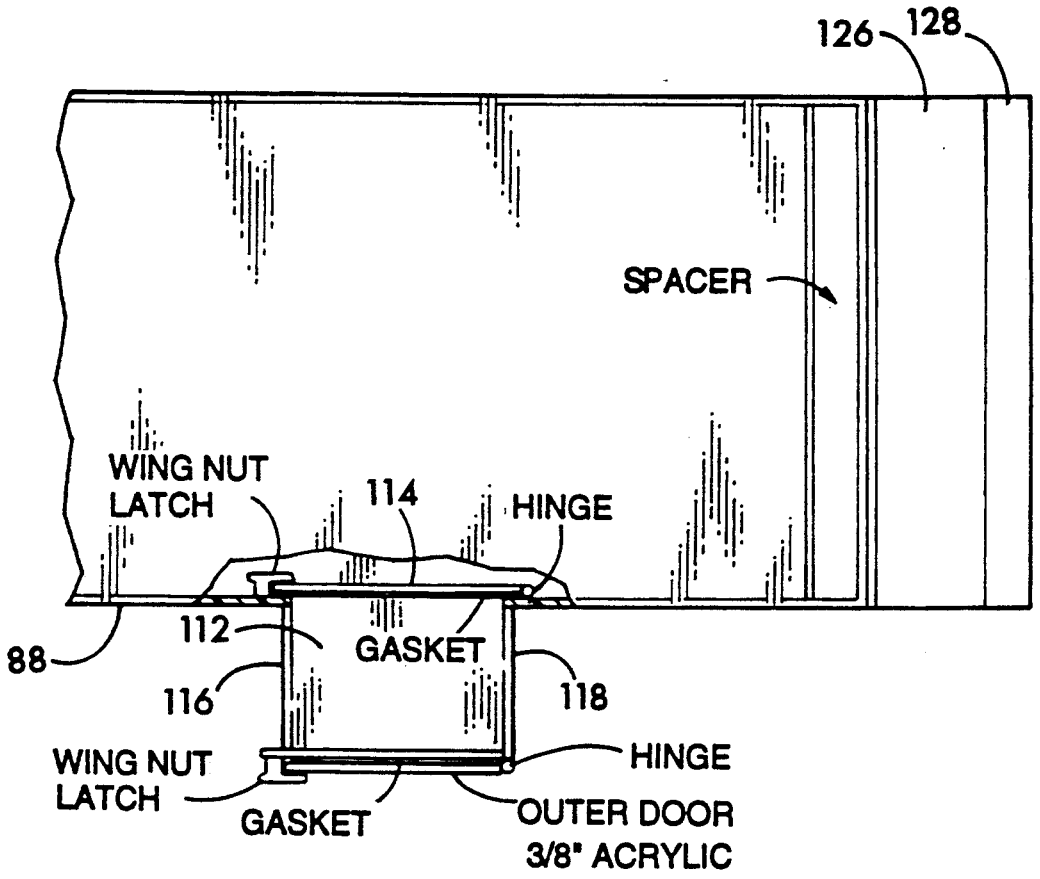
FIG. 10 is a top plan view of the containment center of FIG. 5 taken along lines 10—10 of FIG. 5.

To the right of the sink is the entrance area for initial placement of sample in the containment center 70. As illustrated in FIGS. 2 and 8, an acrylic exhaust plenum 102 is attached to the back side 82 of the containment center 70 and is positioned parallel to the sink 96 and door 92. Two 6 in. exhaust ports 104, 106 are attached to the exhaust plenum 102 and one port 104 is aligned to the sink 96 area and one to the entrance area at door 92. An adjustable acrylic faceplate 108, illustrated in FIG. 9, can completely open or shut the exhaust plenum 102 or it can be moved to have either area directly exhausted. Thus, for example, if acid vapors or pathogens are emanating from materials that are being manipulated in the sink area 96, the faceplate 108 can be arranged to direct exhaust from the sink area 96 without spread to the entrance 101 or downstream (to the right) areas of the containment center 70.

The variable speed exhaust system allows for ready increases in air flow to flush out spills or for other emergency operations. The two 6 in. exhaust ports 104, 106 are connected to a main 8 in. PVC duct (not illustrated) which leads to a roof fan that is variable speed controlled (⅓ horsepower direct drive Dayton motor with forward curved centrifugal type blower assembly).

Downstream of the entrance are additional iris ports 90 present on the bottom vertical front face 88 of the containment center 70. The iris ports 90 are superior to glove arms for general maneuverability and speed of operations without any noticeable leakage of outside laboratory air. Inside the center and parallel to these iris ports is the working area 110 for quantitative measurements, dilutions, transfers and other manipulations.

A double-door transition box 112 allows for exiting of samples without leakage of outside air back into the containment center 70. Clean samples or equipment exit from the containment center 70 through the transition box 112 that is located downstream and close to the right end of the containment center 70. The acrylic box measures roughly 12 in.×12 in. and 8 in. deep and contains an inner door 114 hingedly attached to the drop face 88, side walls 116, 118, a top surface 120, a bottom surface 122 and an outer door 124 hingedly attached to the sidewall 118, which provides a double-door exit to prevent outside air from entering the containment center 70.

Located at the far right end of the containment center is the filter, schematically illustrated at 126, preferably a 2 ft.×2 ft. separatorless ULPA filter with particle board frame. The airflow at 90 cfm provides a laminar clean air flow proceeding from the right to left of the containment center 70. This provides for convenient hand, sample and equipment placements and manipulations that prevents cross-contamination. The horizontal air flow keeps contaminants from entering apertures such as the top of tubes. In contrast, vertical airflow is conducive to this type of contamination and requires very astute manipulations to avoid. In addition, a vertical laminar flow requires a full-length exhaust plenum and filters across the containment center. Optimally, a prefilter 128 may be attached to the filter 126.

The horizontal air flow provides for a simplistic and effective working process of contaminating to cleaner air in the work direction of left to right. The ULPA filter 126 is gasketed to an acrylic adaptor for fitting onto the pentagon shaped containment center end. The ULPA filter is 99.9995% efficient on particles of 0.12 microns or larger and uses the surrounding air as a positive pressure source.

The containment center 70 undergoes 600 air changes per hour at 90 cubic feet per minute air flow and thus approaches a class 1 quality air standard. The negative pressure created by the exhaust enables a horizontal laminar flow of clean air to proceed in the upstream direction from right to left. Thus, in accordance with clean room operations for prevention of cross-contamination of samples, the sequential preparation and processing steps are in the direction of higher (upstream) to lower (downstream) contaminant concentration.

Iris ports 90 are traversed with hands and arms that are covered with thin, 4 mil non-aluminum containing gloves and Tyvek arm sleeves. Hand placement or sample manipulations are done in a manner to prevent carry over of contaminants to downstream samples.

As described below, there is no concern about fumes liberated during the analysis procedure because the work is under 100% outside exhaust. Samples are preferably removed from the containment center 70 and moved to the atomic absorption instrument 72 under the vertical laminar airflow from the ceiling mounted ULPA air filter 50 in an eight foot square area that includes the transition box 112, support structure 76, atomic absorption instrument 72 and four square feet for operator space 80. The transfer of the sampler tray from the transition box 112 to the atomic absorption machine 72 is all under vertical laminar ULPA airflow. Thus at no time in the procedure is the sample exposed to unfiltered ULPA air that is at least a Class 10 environment.

It is understood that the invention is not confined to the particular construction and arrangement herein described, but embraces such modified forms thereof as come within the scope of the following claims.

What is claimed is:

1. A clean room containment center having at least about a Class 100 limit particle concentration standard designed to be placed on a relatively horizontal surface comprising:

a. a modular substantially transparent box comprising substantially metal-free parts, the box having a top surface, a bottom surface a front wall, a back wall and side walls, each of the walls depending from the top surface;

b. at least one iris arm port in the front wall of the box;

c. at least one entrance door for sample manipulation;

d. a filtering means is positioned on one of the sidewalls providing a horizontal laminar filtered air flow, wherein the filtering means provides at least about a Class 100 limit particle concentration standard; and e. exhaust means creating negative pressure within the containment center.

2. The containment center of claim 1 wherein the box is made of plexiglass.

3. The containment center of claim 1 wherein the box is sufficiently sturdy to withstand the negative air pressure generated within the box.

4. The containment center of claim 1 wherein the box is formed with a viewing angle.

5. The containment center of claim 1 wherein the iris arm port is an elliptically shaped port.

6. The containment center of claim 1 comprising at least, two iris arm ports in the front wall.

7. The containment center of claim 1 comprising a filtering means which provides at least about a Class 10 limit particle concentration standard.

8. The containment center of claim 1 comprising a filtering means which provides a Class 1 limit particle concentration standard.

9. The containment center of claim 8 further comprising a transition box.

10. The containment center of claim 9 wherein the transition box is a double-door transition box which allows for exiting of samples without leakage of outside air back into the containment center.

11. The containment center of claim 9 wherein the transition box is positioned adjacent the filtering means.

12. The containment center of claim 1 further comprising a sink.

13. The containment center of claim 12 wherein the sink is positioned near the side wall opposite the filtering system.

14. The containment center of claim 13 wherein the horizontal surface is provided with a downward slope in the direction of the sink.

15. The containment center of claim 1 wherein the exhaust means comprises adjustable ports.

16. The containment center of claim 1 wherein the air blower means comprises means to provide approximately 600 air changes per hour in the chamber.

17. The containment center of claim 1 comprising a variable speed exhaust means.

18. A clean room and clean room containment center combination comprising:

a. clean room having at least about a Class 100 limit particle concentration standard, which clean room includes:

1) a substantially-metal free chamber having a ceiling, sidewalls depending therefrom and a floor, wherein the chamber includes a first anteroom and a second laboratory room, the first anteroom and the second laboratory room being separated by a dividing wall positioned inside the chamber wherein the dividing wall includes means allowing passage between the room; the first anteroom and second laboratory room comprising means to form a positive pressure entry system;

2) an air blower means for blowing air into the chamber;

3) filtering means for filtering contaminant particles from air entering the chamber, wherein the filtering means is a filtering system which effectively provides at least about a Class 100 limit particle concentration standard; and 4) exhaust means for discharging filtered air from the chamber; and b. a clean room containment center having at least about a Class 10 limit particle concentration standard comprising:

1) a modular substantially transparent box comprising substantially metal-free parts, the box having a top surface, a bottom surface, a front wall, a back wall and side walls, each of the walls depending from the top surface;

2) at least one iris arm port in the front wall of the box;

3) at least one entrance door for sample manipulation;

4) a filtering means is positioned on one of the sidewalls providing a horizontal laminar filtered air flow, wherein the filtering means provides at least about a Class 10 limit particle concentration standard; and 5) exhaust means creating negative pressure within the containment center.

* * * * *

UNITED STATES PATENT AND TRADEMARK OFFICE

CERTIFICATE OF CORRECTION

PATENT NO. : 5,259,812

DATED : November 9, 1993

INVENTOR(S) : Don A. Kleinsek

It is certified that error appears in the above-indentified patent and that said Letters Patent is hereby corrected as shown below:

Claim 9, column 13, line 41, "claim 8" should read --claim 1--.

Signed and Sealed this

Twenty-third Day of August, 1994

*Attest:*

BRUCE LEHMAN

*Attesting Officer*

*Commissioner of Patents and Trademarks*